US008220736B2

(12) United States Patent
Tsai

(10) Patent No.: US 8,220,736 B2
(45) Date of Patent: Jul. 17, 2012

(54) WEB SEPARATOR WITH REVERSE ROTATION MECHANISM FOR TISSUE PAPER WINDING MACHINE

(75) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 480 days.

(21) Appl. No.: 11/902,812

(22) Filed: Sep. 26, 2007

(65) Prior Publication Data

US 2009/0026299 A1 Jan. 29, 2009

(30) Foreign Application Priority Data

Jul. 27, 2007 (TW) ..... 96127668 A

(51) Int. Cl.
*B65H 19/26* (2006.01)
*B65H 19/28* (2006.01)
*B65H 20/16* (2006.01)

(52) U.S. Cl. ..... 242/532.2; 242/521; 242/542.3

(58) Field of Classification Search ..... 242/526.1, 242/532.2, 542, 542.2, 542.3, 521, 526; 156/285, 156/210, 576; 162/283; *B65H 19/26, 19/28, B65H 35/08, 20/16*
See application file for complete search history.

(56) References Cited

U.S. PATENT DOCUMENTS 4,529,141 A * 7/1985 McClenathan ..... 242/527.1
4,770,404 A * 9/1988 Ueyama et al. ..... 271/5
5,092,533 A * 3/1992 Gangemi ..... 242/521
6,948,677 B2 * 9/2005 Biagiotti et al. ..... 242/521
7,172,151 B2 * 2/2007 Biagiotti et al. ..... 242/521
8,100,357 B2 * 1/2012 Tsai ..... 242/532.2
2003/0189123 A1 * 10/2003 Biagiotti et al. ..... 242/521
2004/0061021 A1 * 4/2004 Butterworth ..... 242/521
2004/0256513 A1 * 12/2004 Perini ..... 242/521
2005/0279875 A1 * 12/2005 Biagiotti et al. ..... 242/533
2007/0095967 A1 * 5/2007 Biagiotti et al. ..... 242/526
2009/0095836 A1 * 4/2009 Maddaleni et al. ..... 242/526
2010/0101185 A1 * 4/2010 Maddaleni et al. ..... 242/521

FOREIGN PATENT DOCUMENTS

GB 1435525 A * 5/1976
JP 03158350 A * 7/1991
WO WO 2005075328 A1 * 8/2005

* cited by examiner

*Primary Examiner* — William A Rivera
*Assistant Examiner* — Stefan Kruer
(74) *Attorney, Agent, or Firm* — Rosenberg, Klein & Lee

(57) ABSTRACT

A tissue paper winding machine includes a first winding roller and a web separator arranged below the first winding roller. A tissue paper is fed into the winding machine to bear against a lower circumferential surface of the first winding roller and moves along a predetermined feeding direction for winding around a core. The web separator includes a pivot shaft, at least one pinch arm having a connecting end connected to the pivot shaft and a pressing end radially outward extended from the pivot shaft, and a driving mechanism for driving the pinch arm to turn about the pivot shaft reverse to the feeding direction of the tissue paper. When the pressing end of the pinch arm is turned to a separation position, it cooperates with the first winding roller to clamp the tissue paper therebetween, and applies a reverse pulling force to split the tissue paper.

5 Claims, 12 Drawing Sheets

WEB SEPARATOR WITH REVERSE ROTATION MECHANISM FOR TISSUE PAPER WINDING MACHINE

FIELD OF THE INVENTION

The present invention relates to a web separator for a tissue paper winding machine, and more particularly, to a web separator which tears a web by a reverse rotation mechanism.

BACKGROUND OF THE INVENTION

In a conventional tissue paper winding machine, a core is generally sent by a conveyor to a first winding roller and pushed by a core inserter into a guiding passage to a winding nip, at where a long tape of tissue paper is wound around the core to form a roll of paper, such as a rolled tissue paper. When the winding of a first roll of paper is completed, the tissue paper is torn by a device.

U.S. Pat. No. 5,769,352 discloses a web rewinding machine adaptable to different core diameters. The web winding machine includes an interrupting means which rotates about a rotating element at a speed slightly lower than the speed of the feed of the web material. The interrupting means interrupts the web material and consequently, the web material is torn. Then, a pusher is actuated to push a new core to the entrance of the channel. In the prior art, the rotation direction of the interrupting means is the same as the feeding direction of the web material.

In U.S. Pat. No. 6,877,689, the rewinder apparatus uses a web separator to separate a web material. The web separator may comprise a presser rotating in the same direction as the web material and having a lower speed than that of the web material, or a severing means having blades.

However, in the above conventional tissue paper winding machine, care must be taken for the rotary member to rotate at a speed not equal to that of the first winding roller in order to pull apart the tissue paper utilizing a speed difference. In the case the tissue paper is made of a highly tough material, the speed difference between the rotary member and the first winding roller must be large enough to pull apart the tissue paper.

Moreover, since the rotary member is rotated in a direction the same as the moving direction of the tissue paper in the winding machine, the rotary member does not provide the function of catching a new leading edge of the torn tissue paper for winding the leading edge to a next core.

SUMMARY OF THE INVENTION

A primary object of the present invention is to provide a tissue paper winding machine including a web separator which is driven to rotate in a direction reverse to the feeding direction of the tissue paper that hinders the forward movement of the tissue paper and generates a pulling force at the tissue paper which is then pulled apart.

Another object of the present invention is to provide a web separator which includes a plurality of pinch arms connecting to a suction channel and a suction pump for drawing out air from the suction channel and the passages in the pinch arms to generate a suction force, that enables smooth winding of the tissue paper around a next core.

To achieve the above and other objects, the tissue paper winding machine according to the present invention includes a first winding roller and a web separator. A long tape of tissue paper is fed to attach to a lower circumferential surface of the first winding roller and move along a predetermined feeding direction for winding around a first core. The web separator is arranged near and below the first winding roller, and includes a pivot shaft, at least one pinch arm, and a driving mechanism. The pivot shaft has an outer circumferential surface. The pinch arm is connected to the outer circumferential surface of the pivot shaft, and has a connecting end mounted onto the outer circumferential surface of the pivot shaft, and a pressing end radially outward extended from the outer circumferential surface of the pivot shaft. The driving mechanism is connected to the pivot shaft for driving the pinch arm to turn about the pivot shaft in a direction opposite to the feeding direction of the tissue paper, so that the pressing end of the pinch arm is turned to a separation position, at where the pressing end of the pinch arm touches and presses against the circumferential surface of the first winding roller, or away from the separation position. When the pinch arm is driven by the driving mechanism to turn the pressing end to the separation position, the tissue paper passing between the first winding roller and the pressing end of the pinch arm is clamped thereto, and the pressing end of the pinch arm applied a pulling force against the tissue in a direction reverse to the feeding direction of the tissue paper, so that the tissue paper is pulled apart near the separation position into a trailing edge that is closer to the first core, and a leading edge that is closer to a second core. The trailing edge of the tissue paper follows the tissue paper already wound around the first core to complete a roll of paper.

In a preferred embodiment of the present invention, the pivot shaft of the web separator is a hollow shaft internally defining an axially extended suction channel, and provided on the outer circumferential surface at predetermined positions with at least one aperture communicating with the suction channel. And, the pinch arm is internally provided with at least one passage communicating at two ends with the pressing end and the aperture on the pivot shaft. A suction pump is connected to the pivot shaft for extracting air from the suction channel of the pivot shaft and the passage of the pinch arm, so that a suction force is generated at the pressing end of the pinch arm. When the tissue paper is pulled apart near the separation position, the leading edge of the tissue paper is sucked to the pressing end of the pinch arm and brought to the second core for primarily winding around an outer circumferential surface of the second core.

In another embodiment of the present invention, the tissue paper winding machine further includes an air injection mechanism arranged near and below the first winding roller. When the leading edge of the tissue paper is brought by the pressing end of the pinch arm to primarily wind around the second core, the air injection mechanism is actuated to inject a strong airflow toward the leading edge of the tissue paper for the leading edge to completely wind around the outer circumferential surface of the second core.

With the web separator, the tissue paper on the winding machine may be easily pulled apart with the pinch arm being rotated at any rotation speed, even if the tissue paper is made of a highly tough material. Moreover, with the suction pump, the pinch arm may suck the newly formed leading edge of the pulled apart tissue paper to facilitate smooth winding of the leading edge to a next core.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
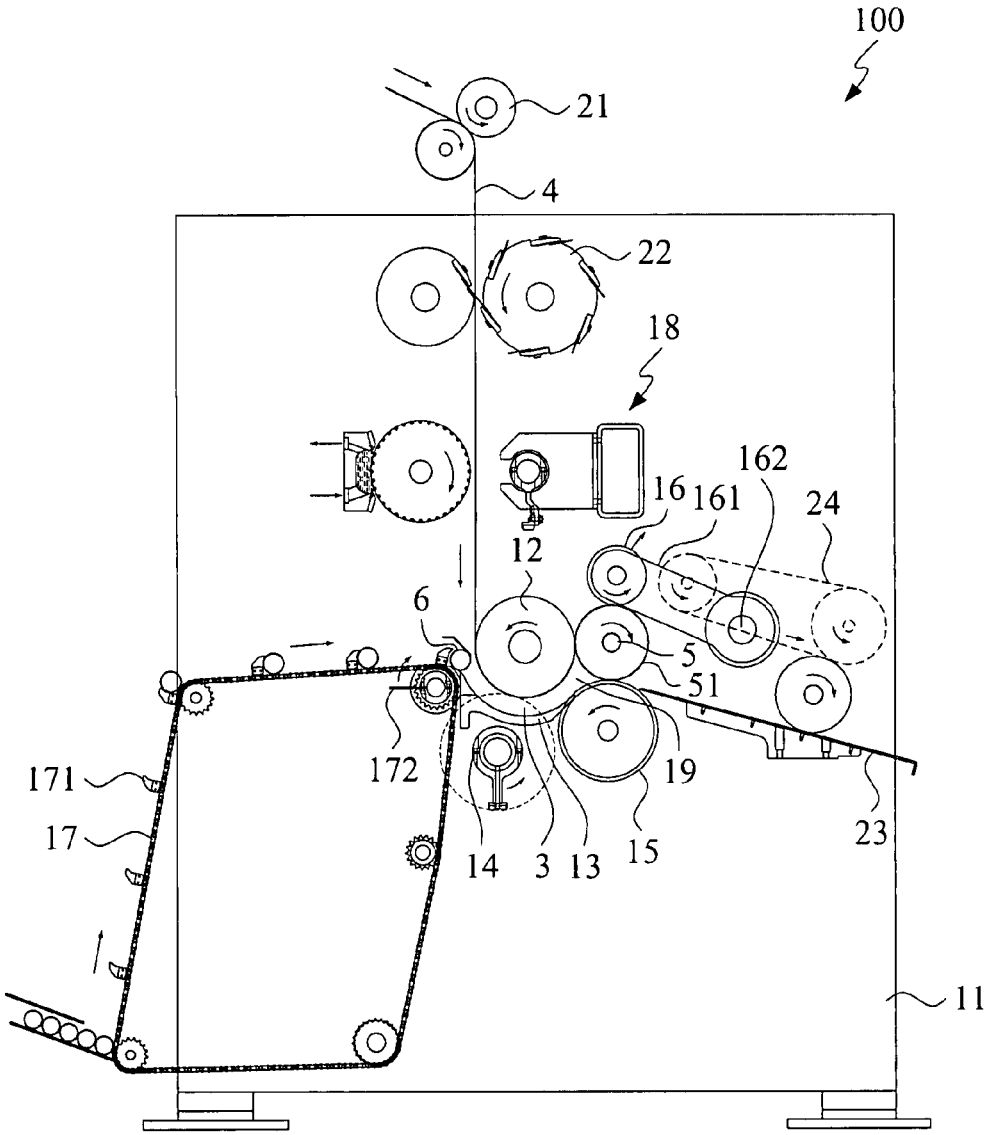
FIG. 1 is a side view of a tissue paper winding machine including a web separator with reverse rotation mechanism constructed according to a first embodiment of the present invention.

Please refer to FIG. 1, which is a side view of a tissue paper winding machine including a web separator with reverse rotation mechanism constructed according to a first embodiment of the present invention. The tissue paper winding machine is generally denoted a reference numeral 100, and includes a machine frame 11, a first winding roller 12, a plurality of core support plates 13 (only one can be seen in the figure), a web separator 14, a second winding roller 15, a rider roller 16, a conveyor 17, a gluing mechanism 18, a pair of feed rollers 21, a perforation roller 22, a chute 23, and a belt 24.

The core support plates 13 are located near and below the first winding roller 12, such that a channel 3 is defined between the core support plates 13 and the first winding roller 12. A winding nip 19 is defined between the first winding roller 12, the second winding roller 15, and the rider roller 16. A long tape of tissue paper 4 having a predetermined thickness and width is fed to the winding machine 100 via the feed rollers 21, and then moved through the perforation roller 22 which perforates the tissue paper 4 and forms a line of perforation across the tissue paper 4 at fixed intervals. An amount of tail glue and initial glue (not shown in FIG. 1) are separately applied onto the tissue paper 4 by the gluing mechanism 18, and then the tissue paper 4 is moved to bear against a lower circumferential surface of the first winding roller 12 and wound around a first core 5 at the winding nip 19 to thereby form a roll of paper 51 having a predetermined diameter, such as a roll of toilet paper, kitchen paper and so on.

Figure 2:
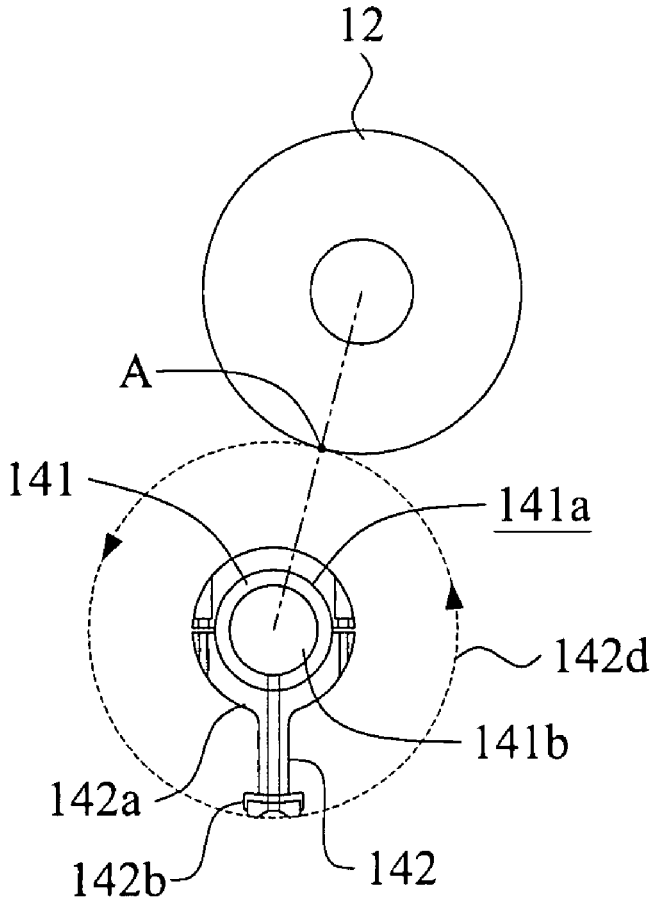
FIG. 2 is a side view showing the movement of the web separator relative to a first winding roller of the tissue paper winding machine.
Figure 3:
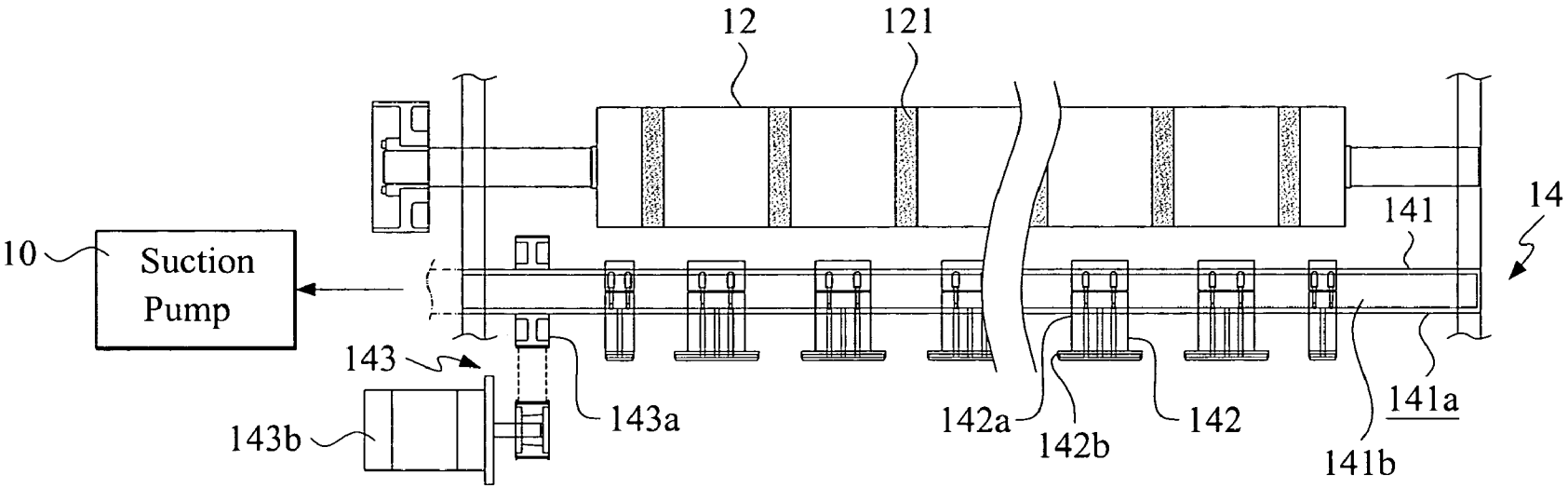
FIG. 3 is front view of the web separator of the present invention.

Please refer to FIGS. 2 and 3. The first winding roller 12 is formed on the circumferential surface with a plurality of axially spaced rough areas 121. The web separator 14 is arranged near and below the first winding roller 12, and includes a pivot shaft 141, a plurality of pinch arms 142, and a driving mechanism 143. The pivot shaft 141 includes an outer circumferential surface 141*a*, and is fixed to the machine frame 11. The pinch arms 142 are arranged on the outer circumferential surface 141*a* of the pivot shaft 141. Each of the pinch arms 142 has a connecting end 142*a* and a pressing end 142*b*. The connecting end 142*a* is fixedly mounted onto the outer circumferential surface 141*a* of the pivot shaft 141, and the pressing end 142*b* is radially outward extended from the outer circumferential surface of the pivot shaft 141.

The driving mechanism 143 is connected to the pivot shaft 141 for driving the pinch arms 142 to turn about the pivot shaft 141 in a direction opposite to a feeding direction of the tissue paper 4. Therefore, the pressing ends 142*b* of the pinch arms 142 may be turned to or away from a separation position A. When being turned to the separation position A, the pressing ends 142*b* of the pinch arms 142 touch and press against the circumferential surface of the first winding roller 12. The movement of the pinch arms 142 forms a circular orbit 142*d*. The driving mechanism 143 includes a transmission means 143*a* and a motor 143*b*, and the transmission means 143*a* is driven by the motor 143*b* to operate.

Figure 4:
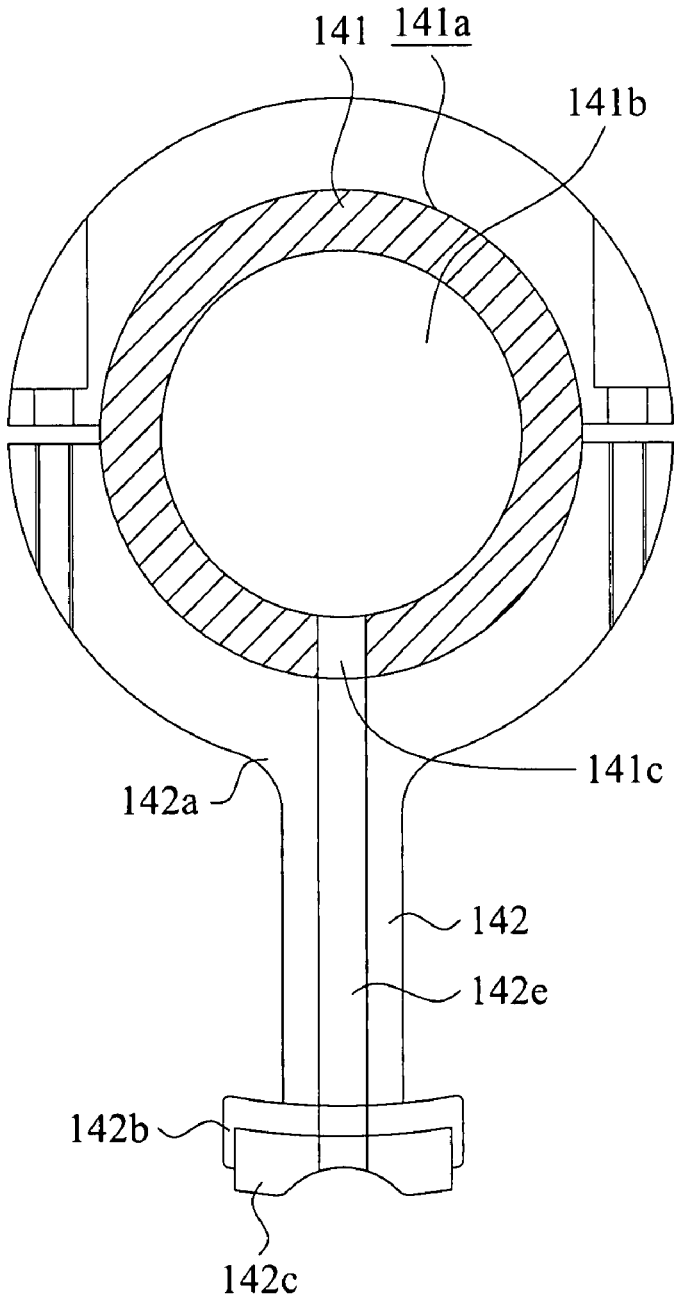
FIG. 4 is a cross sectional view showing a pivot shaft and a pinch arm of the web separator.

Please also refer to FIG. 4. The pressing end 142*b* of each pinch arm 142 has an elastic friction member 142*c* connected thereto. The pivot shaft 141 is a hollow shaft internally defining an axially extended suction channel 141*b*, and is formed on the outer circumferential surface 141*a* at predetermined positions with a plurality of apertures 141*c* communicating with the suction channel 141*b*. Each of the pinch arms 142 is internally provided with at least one passage 142*e* communicating at two ends respectively with the pressing end 142*b* and at least one aperture 141*c* on the pivot shaft 141. A suction pump 10 is connected to the pivot shaft 141 for drawing out air from the suction channel 141*b* of the pivot shaft 141 and the passages 142*e* of the pinch arms 142, so that a suction force is generated at the pressing ends 142*b* of the pinch arms 142.

Figure 5:
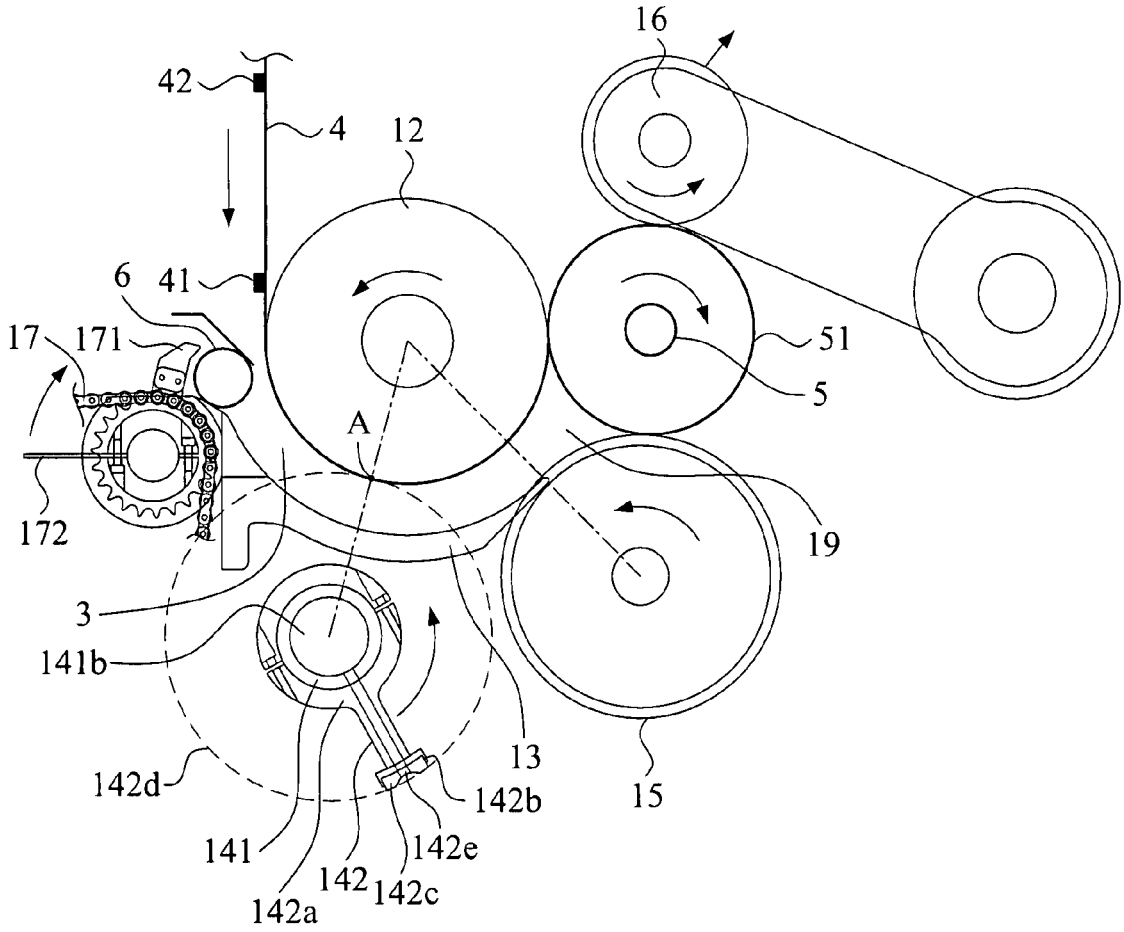
FIG. 5 shows a second core is about to move into a channel between the first winding roller and a plurality of core support plates of the tissue paper winding machine.

As can be seen from FIG. 5, when a roll of paper 51 is about to complete at the first core 5, the gluing mechanism 18 is driven to apply the tail glue 41 and the initial glue 42 on the following tissue paper 4. The tail glue 41 is used to bond the tissue paper 4 to the roll of paper 51 to complete the winding of the rolled paper 51. The initial glue 42 is used to bond the tissue paper 4 to a second core 6.

Figure 6:
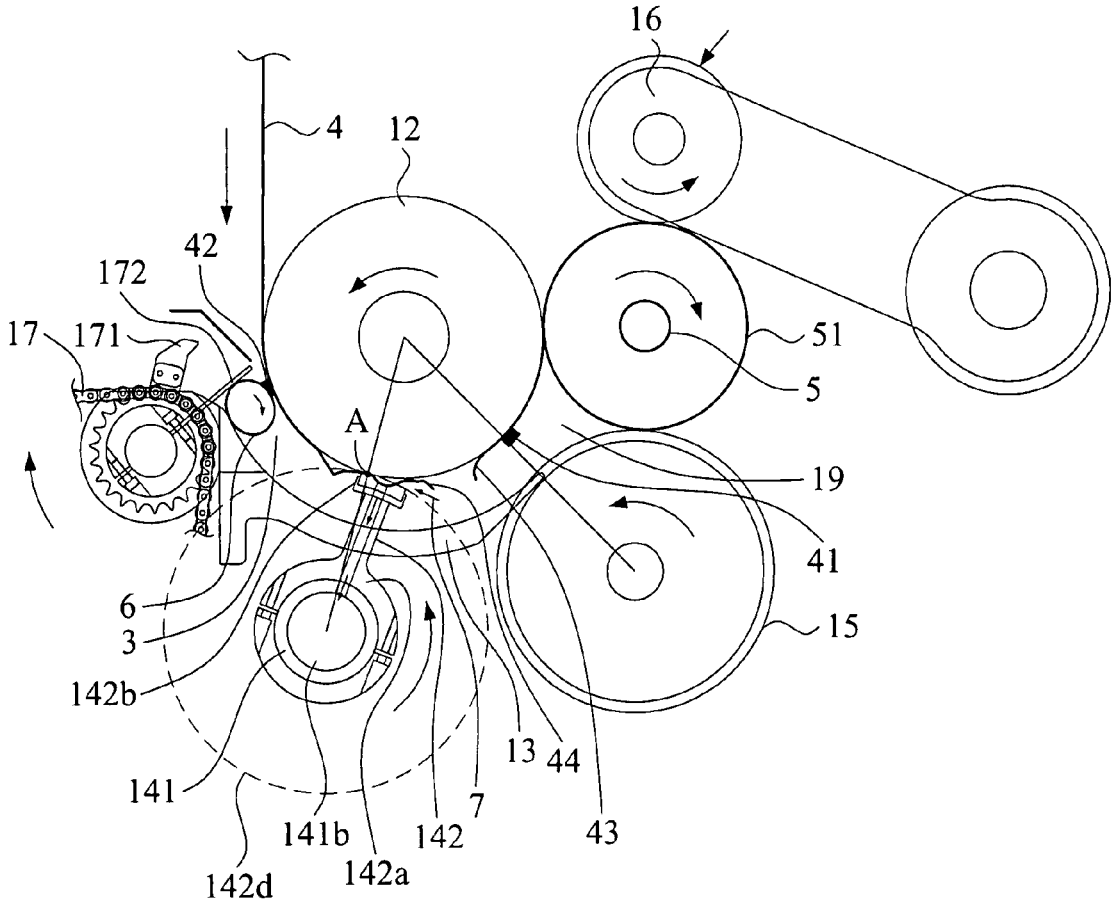
FIG. 6 shows a pressing end of the pinch arm applies a pulling force against the feeding tissue paper to pull the tissue paper apart.

Please refer to FIG. 6. When the pinch arms 142 are driven by the driving mechanism 143 to turn the pressing ends 142*b* to the separation position A, the tissue paper 4 passing between the first winding roller 12 and the pressing ends 142*b* of the pinch arms 142 is clamped thereto. At this point, the pressing ends 142*b* of the pinch arms 142 apply a pulling force 7 against the tissue paper 4 in a direction opposite to the feeding direction of the tissue paper 4, so that the tissue paper 4 is pulled apart near the separation position A and forms respectively a trailing edge 43 at the tissue paper 4 that keeps moving to the first core 5, and a leading edge 44 at the feeding tissue paper 4 which is closer to the second core 6. The trailing edge 43 of the tissue paper 4 is then wound around the first core 5 to complete the roll of paper 51.

The second core 6 is carried by one of many carriers 171 of the conveyor 17 to a loading nip of the channel 3 formed between the first winding roller 12 and the core support plates 13. At this point, a core inserter 172 of the conveyor 17 is automatically turned to push the second core 6 into the channel 3, so that the tissue paper 4 is adhered to the second core 6 by the initial glue 42.

Figure 7:
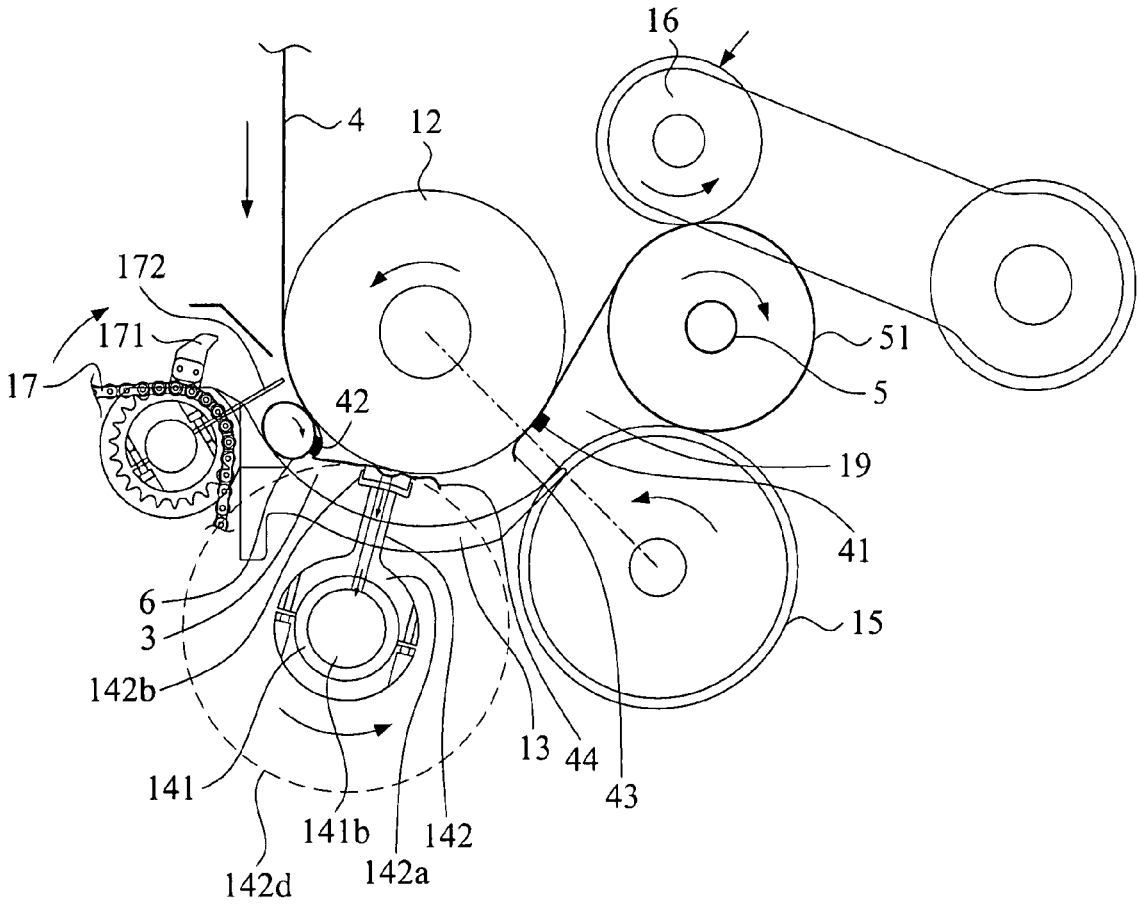
FIG. 7 shows the pressing end of the pinch arm sucks the tissue paper thereto.
Figure 8:
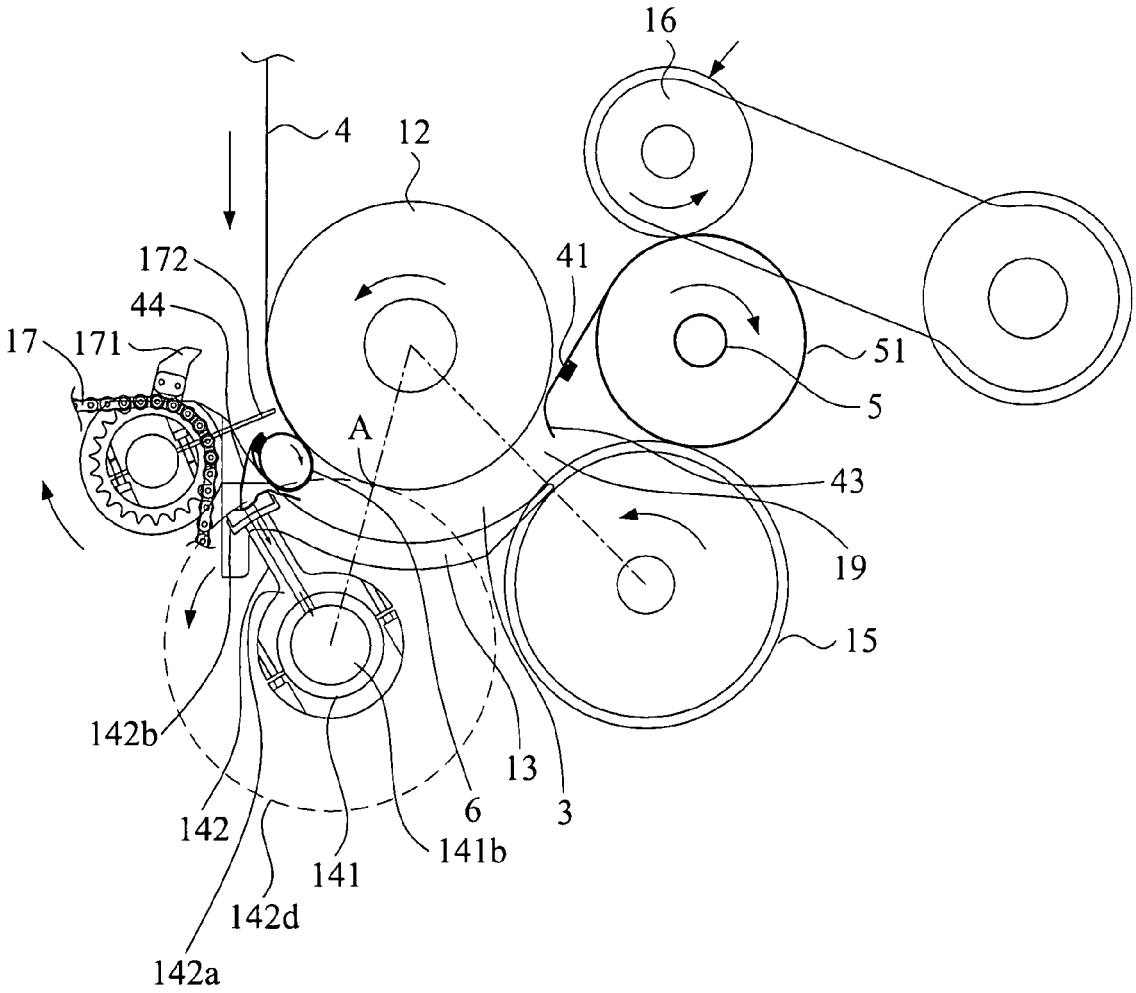
FIG. 8 shows the pressing end of the pinch arm sucks the tissue paper thereto and brings the tissue paper toward a second core.

Please refer to FIGS. 7 and 8 at the same time. While the tissue paper 4 is pulled apart, the suction pump 10 is enabled to extract air from the suction channel 141*b* of the pivot shaft 141 and the passages 142*e* of the pinch arms 142, so as to suck the leading edge 44 of the tissue paper 4 to the pressing ends

142*b* of the pinch arms 142. Meanwhile, the pinch arms 142 are kept turning reverse to the feeding direction of the tissue paper 4 and thereby bring the leading edge 44 of the tissue paper 4 toward the second core 6, causing the leading edge 44 to be primarily wound around an outer surface of the second core 6.

Figure 9:
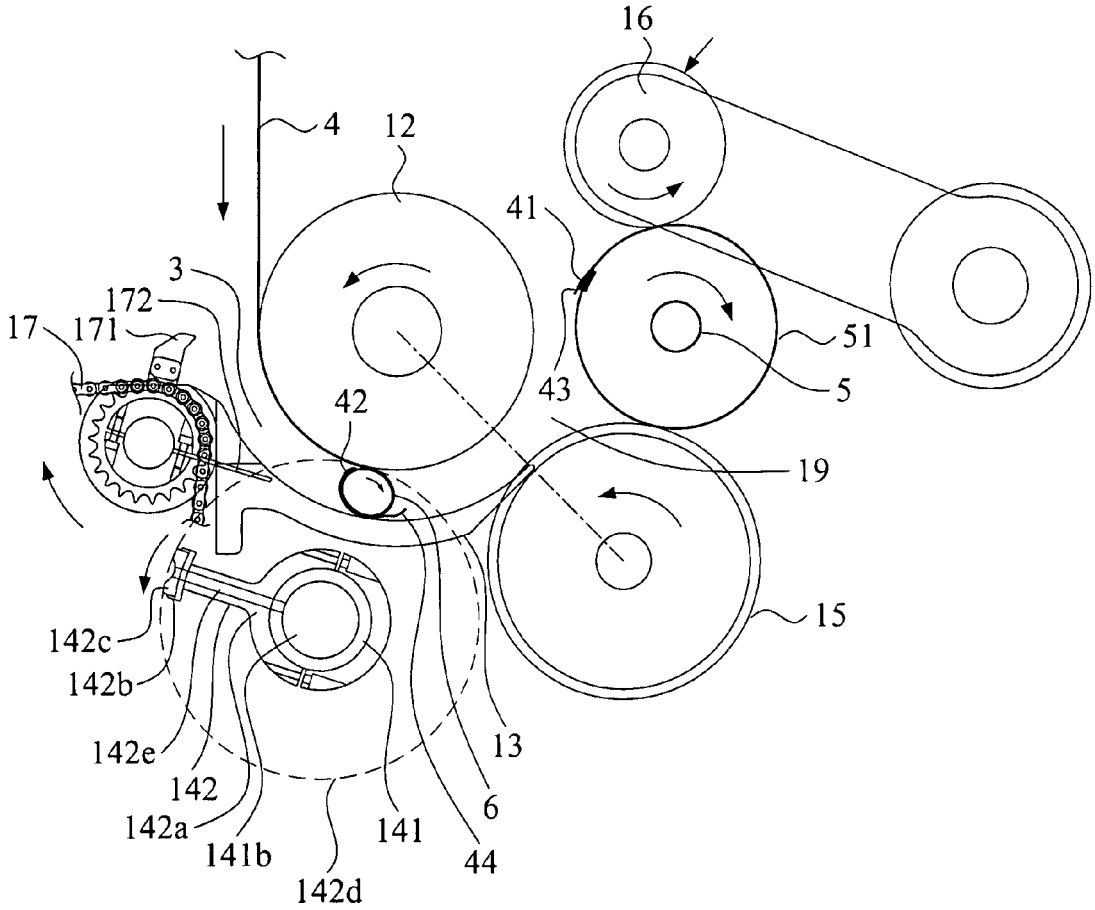
FIG. 9 shows the pressing end of the pinch arm is turned away from the tissue paper.

Please refer to FIG. 9. When the pinch arms 142 have been turned away from the tissue paper 4 and the channel 3, the second core 6 keeps rolling forward along the channel 3, and the leading edge 44 of the tissue paper 4 is completely wound around the second core 6. Meanwhile, the trailing edge 43 of the tissue paper 4 is attached to the roll of paper 51 via the tail glue 41 to complete the winding of the roll paper 51.

Figure 10:
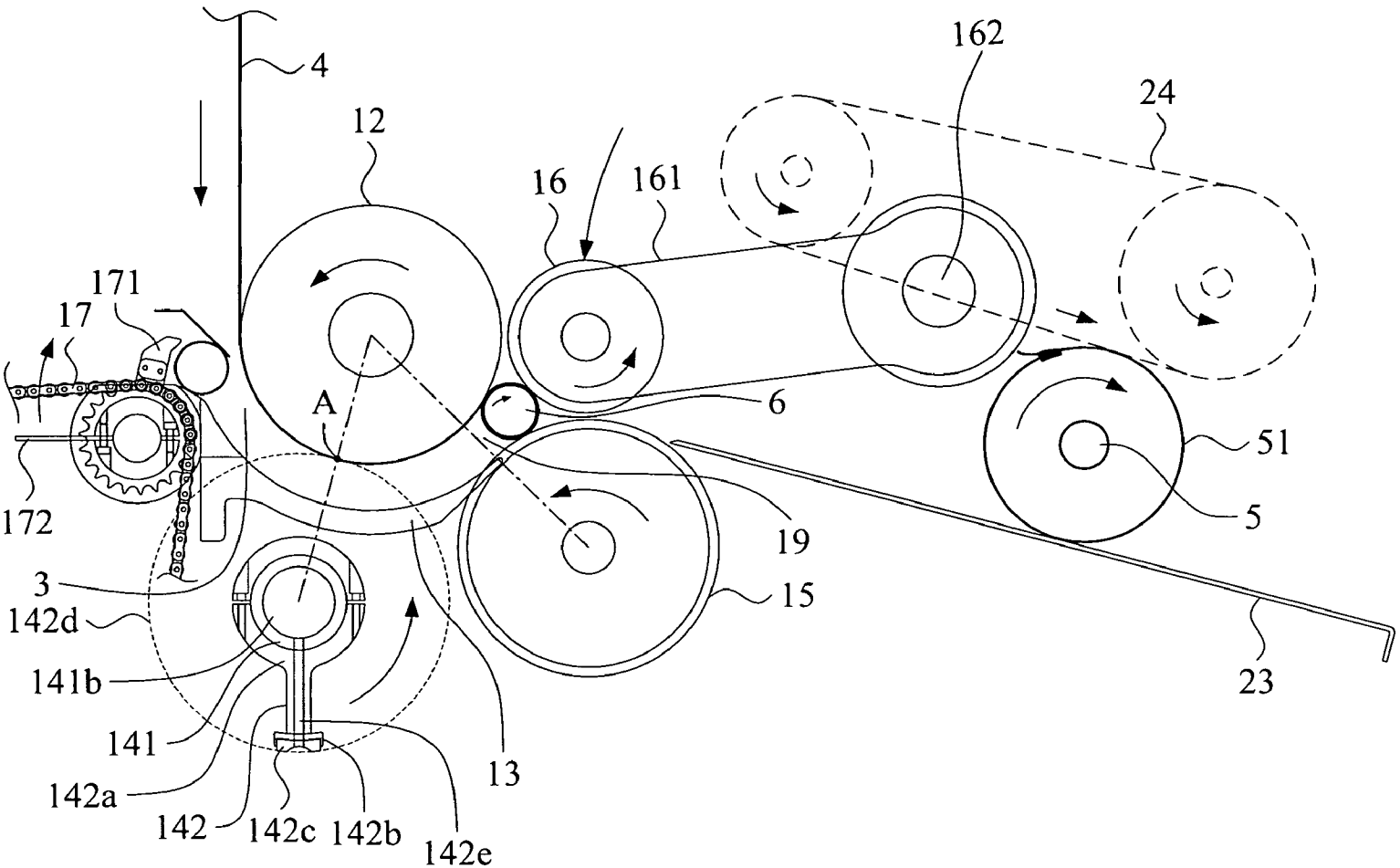
FIG. 10 shows that the first core with fully wound tissue paper is discharged from the winding machine and the winding of the tissue paper around the second core starts.

Please refer to FIG. 10. The second core 6 is transferred to the winding nip 19 due to an effect of speed difference between the first winding roller 12 and the second winding roller 15 caused by a speed reduction of the second winding roller 15, and the winding of the following tissue paper 4 around the second core 6 is started. Meanwhile, the completed rolled paper 51 formed on the first core 5 is delivered out along the chute 23 by the belt 24 from the winding nip 19.

The rider roller 16 is connected to an oscillable gripping arm 161. When the oscillable gripping arm 161 is oscillated about a pivot shaft 162 thereof, the rider roller 16 connected to the oscillable gripping arm 161 is brought to move upward and downward along an oscillating orbit (not shown) of the oscillable gripping arm 161. Please refer to FIG. 10. When the rolled paper 51 has been discharged along and between the chute 23 and the belt 24, the rider roller 16 initially pressing against the rolled paper 51 would move downward to press against the second core 6.

Figure 11:
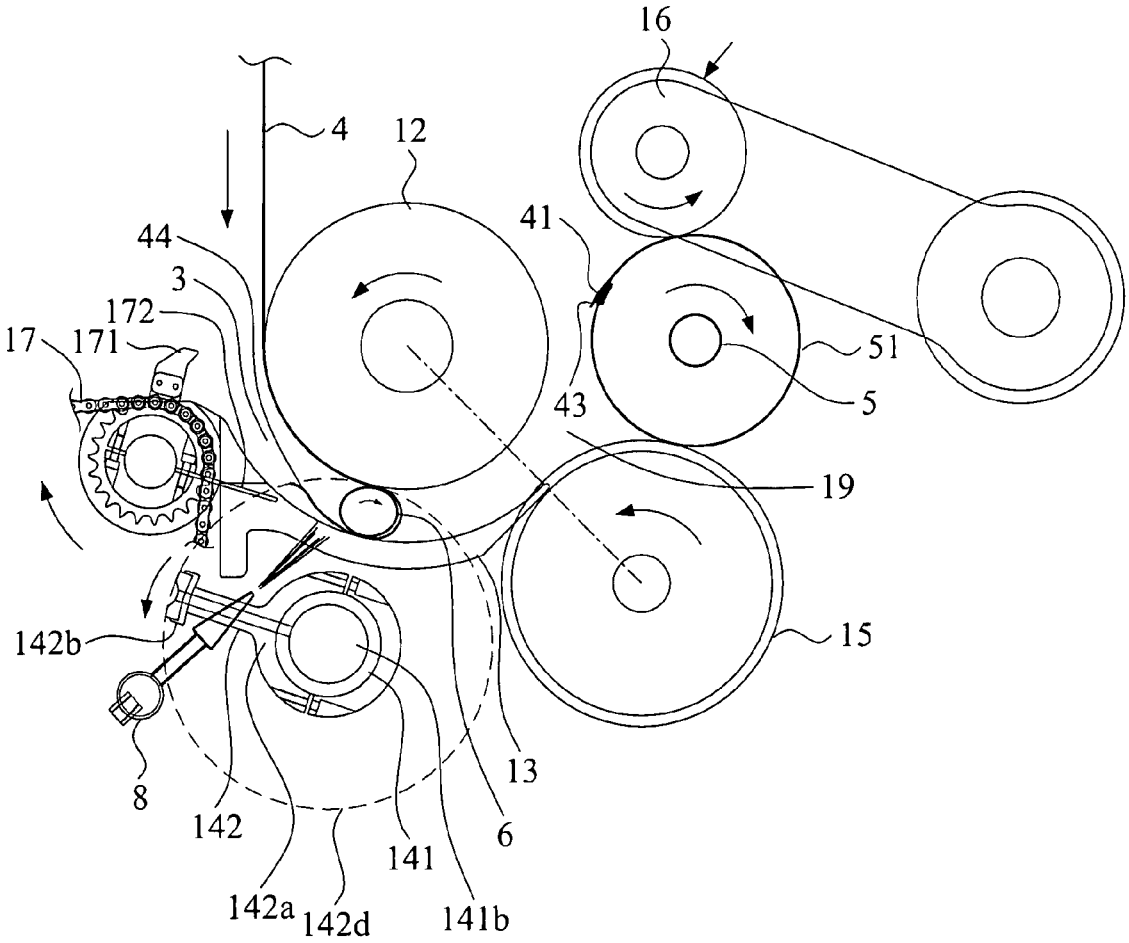
FIG. 11 is a fragmentary side view of a tissue paper winding machine including a web separator and an air injection mechanism constructed according to a second embodiment of the present invention.
Figure 12:
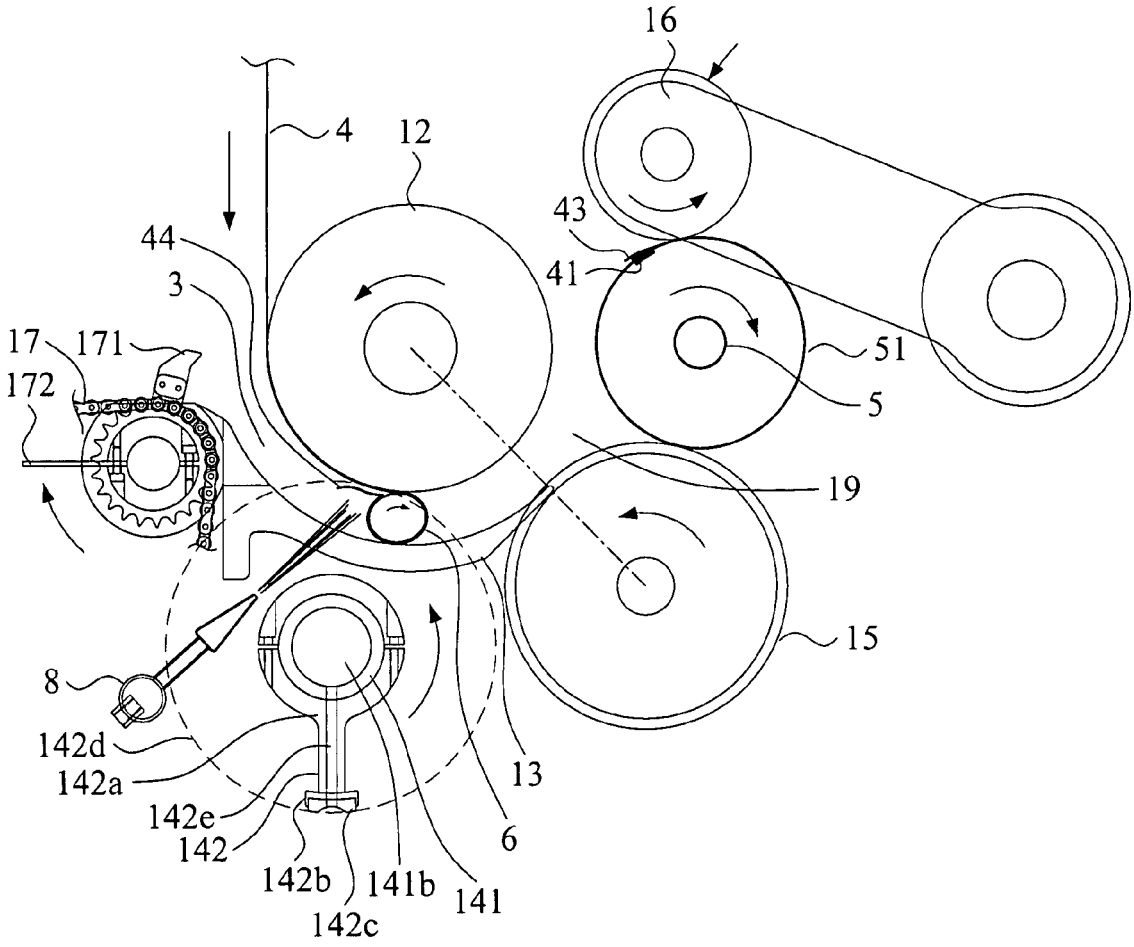
FIG. 12 shows a leading edge of the tissue paper is blown by the airflow of the air injection mechanism to wind around the second core.

In FIGS. 11 and 12, a tissue paper winding machine including a web separator and an air injection mechanism constructed according to a second embodiment of the present invention is shown. The second embodiment is generally structurally similar to the first embodiment, except for an air injection mechanism 8 arranged near and below the first winding roller 12. When the leading edge 44 of the tissue paper 4 is brought by the pressing ends 142*b* of the pinch arms 142 to primarily wind around the outer circumferential surface of the second core 6, the air injection mechanism 8 is actuated to inject a strong airflow toward the leading edge 44 of the tissue paper 4 for the leading edge 44 to completely wind around the second core 6. With the air injection mechanism 8 in the second embodiment of the present invention, the initial glue 42 may be omitted to reduce the amount of glue to be applied onto the tissue paper 4. The design of the air injection mechanism 8 therefore makes the tissue paper winding machine 100 economical and environment-friendly for use.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A tissue paper winding machine comprising:

a first winding roller, to a lower circumferential surface of which a long tape of tissue paper being fed along a predetermined directional path for winding around a first core; and a web separator arranged near and below the first winding roller, and including:

a pivot shaft having an outer circumferential surface, the pivot shaft being a hollow shaft internally defining an axially extended suction channel, the pivot shaft being provided with at least one aperture on the outer circumferential surface at predetermined positions and being in communication with the suction channel;

at least one pinch arm connected to the outer circumferential surface of the pivot shaft; the pinch arm having a connecting end fixedly mounted onto the outer circumferential surface of the pivot shaft, and a pressing end extending radially outwardly from the outer circumferential surface of the pivot shaft, the pinch arm being internally provided with at least one passage communicating at two ends with the pressing end and the aperture on the pivot shaft for fixing said pressing end of said pinch arm to said tissue paper at predetermined intervals; and a driving mechanism connected to the pivot shaft for driving the pinch arm to turn about the pivot shaft in a direction opposite to the moving direction of the tissue paper, so that the pressing end of the pinch arm is turned to a separation position, at where the pressing end of the pinch arm touches and presses against the circumferential surface of the first winding roller, or away from the separation position;

whereby when the pinch arm is driven by the driving mechanism to turn the pressing end to the separation position, the tissue paper passing between the first winding roller and the pressing end of the pinch arm is clamped therebetween, and the pressing end of the pinch arm applies a pulling force against the tissue paper against the predetermined directional path of the tissue paper, so that the tissue paper is pulled apart near the separation position into a trailing edge that is advanced to the first core, and a leading edge that is drawn by the pressing end away from the circumferential surface of the first winding roller to a second core for primary winding around an outer circumferential surface thereof, the leading edge of the tissue paper being sucked to the pressing end of the pinch arm by a suction force provided at the pressing end of the pinch arm, said first winding roller being in continuous rotation throughout the winding of said tissue paper.

2. The tissue paper winding machine as claimed in claim 1, further comprising a suction pump connected to the pivot shaft for drawing out air from the suction channel of the pivot shaft and the passage of the pinch arm.

3. The tissue paper winding machine as claimed in claim 1, further comprising an air injection mechanism arranged near and below the first winding roller; whereby when the leading edge of the tissue paper is brought by the pressing end of the pinch arm to primarily wind around the second core, the air injection mechanism is actuated to inject an airflow toward the leading edge of the tissue paper for the leading edge to completely wind around the outer circumferential surface of the second core.

4. The tissue paper winding machine as claimed in claim 1, wherein the pressing end of the pinch arm has an elastic friction member connected thereto.

5. The tissue paper winding machine as claimed in claim 1, wherein the first winding roller is provided on the circumferential surface with a plurality of rough areas.

* * * * *